United States Patent [19]

Villani

[11] Patent Number: 4,953,762

[45] Date of Patent: Sep. 4, 1990

[54] POURING TUBES

[75] Inventor: Jean P. Villani, Charleville-Mezieres, France

[73] Assignee: Foseco International Limited, Birmingham, England

[21] Appl. No.: 248,987

[22] Filed: Sep. 26, 1988

[30] Foreign Application Priority Data

Sep. 24, 1987 [GB] United Kingdom ..... 8722442

[51] Int. Cl.[5] ..... B22D 41/54

[52] U.S. Cl. ..... 222/606; 222/591; 266/236

[58] Field of Search ..... 222/590, 591, 594, 606, 222/607; 164/335, 337, 437; 501/95; 266/236, 44

[56] References Cited

U.S. PATENT DOCUMENTS 3,279,003 10/1966 Yates ..... 164/337

FOREIGN PATENT DOCUMENTS 1948886 3/1968 Fed. Rep. of Germany ..... 164/337

2740070 3/1978 Fed. Rep. of Germany .

2367555 5/1978 France .

2085544 12/1978 France .

2333599 1/1979 France .

2519287 7/1983 France .

61-266162(A) 11/1986 Japan .

62-158563 7/1987 Japan ..... 222/606

62-158564 7/1987 Japan ..... 222/606

1586293 3/1981 United Kingdom .

2115341A 9/1983 United Kingdom .

*Primary Examiner*—S. Kastler

*Attorney, Agent, or Firm*—Nixon & Vandherye

[57] ABSTRACT

Pouring tubes for use between a ladle and tundish or tundish and mould in continuous casting operations are formed of an inner refractory tube (2) with an outer reinforcing fibrous mat (3) applied around the tube. The fibrous mat may be formed by a helically wound strip and may be impregnated with particulate refractory and optionally a binder to improve the strength and resistance of the composite tube. Metal support means may be attached near one end of the tube.

8 Claims, 2 Drawing Sheets

POURING TUBES

FIELD OF THE INVENTION

This invention relates to pouring tubes for use in casting molten metal consisting of a tube of refractory heat insulating material and to the production of such tubes.

BACKGROUND OF THE INVENTION

Pouring tubes are well known for use in metal casting processes. They are arranged vertically and a stream of molten metal is poured through them. The function of the tube is to protect the stream of molten metal from the surrounding atmosphere. Normally, the stream flows though the tube without touching its sides, but the tube must be able to withstand being full of molten metal in certain circumstances.

In continuous casting, molten metal, most often steel, is fed into a continuous casting mould from a constant head vessel known as a tundish. Molten metal is fed into the tundish from successive ladles of molten metal. The quality of the continuously cast metal strand can be adversely affected by oxide and other non-metallic inclusions, and it is found that the incidence of such inclusions may be reduced if the molten metal is protected from oxidation by the surrounding atmosphere by surrounding the stream of metal with a tube. Simply surrounding the molten metal stream with a tube gives some improvement, but it is highly preferred to inject into the tube an inert atmosphere e.g. to inject nitrogen or argon into the tube, so that the molten metal stream is surrounded by an inert atmosphere as it passes either from ladle to tundish or from tundish to continuous casting mould.

Known pouring tubes (French Patent Specification No. 2333599) consist of a tube of refractory heat insulating material encased in a thin sheet metal casing e.g. of mild steel. Such tubes are expensive to fabricate, requiring the separate manufacture of the refractory heat insulating material member and of a sheet metal casing therefor and the assembly together of the two.

We have now found that effective pouring tubes may be made by a substantially simpler process without any loss of effectiveness.

SUMMARY OF THE INVENTION

According to a first feature of the present invention, there is provided a pouring tube consisting of an inner tubular portion formed of a refractory heat insulating material and an outer skin consisting essentially of a fibrous mat intimately laminated to the refractory heat insulating material inner tubular portion.

By the choice of suitable materials and appropriate dimensioning, pouring tubes constructed in this way may be produced simply and efficiently and used in substitution for the metal encased tubes previously known.

According to a second feature of the present invention, there is provided a method of manufacturing a pouring tube which comprises forming an aqueous slurry comprising particulate refractory material, fibrous material, and binder, dewatering a portion of such aqueous slurry onto a tubular porous mesh walled former to deposit a layer of material thereon, removing the damp tube so formed from the former, applying a mat of fibrous material around the outside of the tube, and drying the formed composite tube to remove residual water and cause the binder to harden or set.

The first manufacturing stage is well known for the production of shaped articles of refractory heat insulating material, for example, heat insulating feeder sleeves for use in casting molten metals to provide a feeder head. Analogous manufacturing operations may be used. This provides a damp shaped unit and, in accordance with the invention, this is then provided with an exterior fibrous mat. This may be applied by any convenient method, for example by simply rolling a suitably shaped damp mat consisting of appropriate fibre and binder about the outside of the damp tubular shape, or, for example, by winding one or more strips of fibrous material in a spiral around the exterior of the tube. Successive laps of the spiral preferably overlap, e.g. by half the width of the strip being wound on, providing a two-layer exterior mat from winding on a single strip.

Both the inner refractory heat insulating material tube and the exterior fibre mat may consist of materials well known for use in the manufacture of articles for contacting molten metal. Thus, the particulate refractory material forming part of the aqueous slurry from which the tube is formed may be selected from e.g. alumina, magnesia, calcined magnesite, calcined bauxite and other refractory oxides and refractory silicates such as aluminosilicates. The fibrous component of the inner tube may be organic and/or inorganic fibre, e.g. paper fibre, repulped newsprint, polyester fibre, alumina fibre, calcium silicate fibre, aluminosilicate fibre, glass fibre, mineral wool, rock wool or slag wool. A variety of binders known for such purposes may also be used e.g. organic binders such as synthetic resins (for example phenol formaldehyde or urea formaldehyde resins) or inorganic binders such as alkali metal or alkaline earth metal silicates, for example sodium silicate.

The fibres in the exterior fibre mat are preferably wholly ceramic or refractory fibre rather than organic fibres or a mixture containing organic fibre. Alumina, alumino silicate and glass fibres may all be used, as may be rock wool and mineral wool. Strips of glass fibre cloth are commercially available, e.g. in standard widths of 8, 12, 16 or 20 cm and standard weights, e.g. of 270 or 500 g/m$^2$, and these may be used very conveniently.

While adequate performance may be obtained using simple two-component pouring tubes as described above, it is highly desirable to take further steps to reduce the possibility that, under the conditions of use, either the inside or the outside of the tube will itself generate any non-metallic inclusions e.g. by disintegration or erosion. It is thus preferable to provide means of consolidating the interior and exterior surfaces and improving their refractoriness.

One preferred approach to doing this is to include in the aqueous slurry from which the interior tube is made one or more ingredients which, under the action of the radiant heat from the stream of molten metal passing through the pouring tube in use, causes the inner tube to sinter. Borax, boric acid, calcium borate and powdered glass, or a combination of two or more of these, may be added to the aqueous slurry to promote such sintering.

The exterior surface refractoriness of the pouring tube may be enhanced by impregnating the fibrous mat with particulate refractory material, for example particulate alumina, bauxite, chromite, graphite, magnesia, magnesite, silica, silicon carbide, silicon nitride, zircon or zirconia. Alternatively or in addition, the fibrous mat may be further impregnated with a binding agent, for example an alkali or alkaline earth metal silicate such as sodium silicate or a phosphate or a colloidal oxide hydrosol such as silica sol or alumina sol. Such impregnation may be effected prior to the application of the fibrous mat or subsequent to its application to the exterior of the inner tubular portion. Impregnation with a refractory material may be effected by dipping, spraying or rolling the fibrous mat or the assembled tube in a suspension of the refractory material in a suitable liquid vehicle such as water or an aqueous binder such as one of those noted above. Alternatively, when the fibrous mat is applied by rolling a strip helically about the tube, the strip may be impregnated by coating or dipping as it is fed towards the rotating tube on to which it is wound. The viscosity and composition of the suspension of refractory may be chosen to provide ease of handling and manufacture, and rapid drying of the damp wound composite tube.

Finally, if desired, the refractoriness of the tube may be yet further enhanced by coating the interior and/or exterior of the dry tube with a refractory dressing or paint. This may be applied by brushing, spraying, rolling, swabbing or dipping and the final coating dried further to enhance the resistance of the tube to attack by molten metal and to improve its thermal shock characteristics.

The dimensions of the final tube may vary widely and will depend on the ladle, tundish and continuous casting mould with which they are to be used. Generally, the tube will have an axial length of between 500 and 2500 mm, an interior diameter of 20 to 100 mm and an exterior diameter of 50 to 200 mm. The tube wall thickness is generally 15 to 50 mm, preferably 25 to 40 mm, most preferably 30 to 35 mm.

The tube may be a true cylinder or may taper, generally slightly inwardly from top to bottom by 5 to 20 mm. In addition, the top interior surface may have a frustoconical surface designed to mate with the frustoconical exterior of a nozzle on the base of the ladle or tundish.

The tube may be held in position by any appropriate engagement means located at the base of the ladle or tundish respectively, and e.g. mounted on a suitable base on the steelworks floor or other structure. In order to provide a particularly simple holding means, one end of the tube may have its exterior surface widening towards the end and a simple metal holding ring may be slipped onto the other end of the tube and moved up the tube until the wider end seats in the ring. The holding ring may have a short tapered cylindrical seating to receive the wider end and support it. Alternatively, a holding ring, e.g. of perforated sheet (the perforations enhancing the mechanical connection between the sheet and the exterior of the refractory tube) having welded on tabs or a flange projecting externally, may be attached to the upper end of the tube, e.g. by refractory cement. In a further alternative, a collar may be formed at the upper end of the tube by winding a strip of fibrous mat several times around the end of the tube to build up a collar. This may be done at the same time as winding the strip helically to reinforce the outer surface of the remainder of the tube.

If the tube is to be used with an injected inert atmosphere, e.g. of nitrogen or argon, an injection pipe may be incorporated in its upper end, e.g. by being incorporated into a metal holding ring as described above. Injection may be at one and more than one radially spaced location, and in the latter case the holding ring may act as a gas distribution manifold.

If the lower end of the tube is to be immersed in molten metal or slag in use, or may become so immersed, it may be additionally protected or strengthened by e.g. increasing its wall thickness near the base or by applying extra layers of fibrous mat, preferably refractory impregnated and firmly bound. The composition of the extra layers may be the same as that of the outer layer or it may be of a different composition having greater resistance to erosion.

BRIEF DESCRIPTION OF THE DRAWING

The invention is illustrated by way of example only with reference to the accompanying drawings in which.

DETAILED DESCRIPTION OF THE DRAWING

Figure 1:
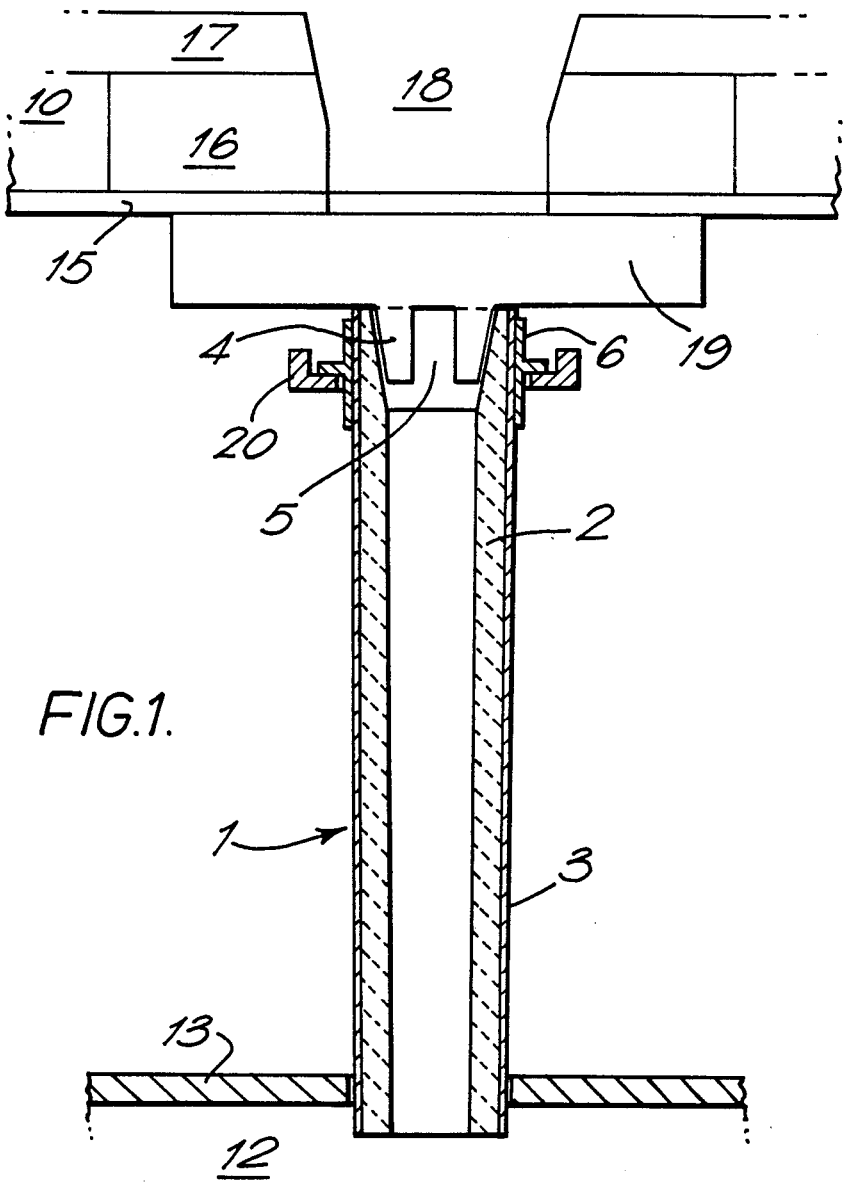
FIG. 1 shows a pouring tube according to the invention located between a ladle and a tundish.

Referring to FIG. 1, this shows a pouring tube 1 shown in section and located between a ladle schematically indicated at 10 and a tundish at 12. Only the heat insulating cover 13 of the tundish is actually shown. This has an aperture through which the lower end of the pouring tube 1 projects.

The ladle 10 is provided with a conventional outer metal casing 15, permanent brick lining 16 and disposable inner lining 17 and has an aperture 18 in its base through which molten metal flows. A so-called slide gate 19 is indicated purely diagrammatically and this controls, in known fashion, the egress of a stream of molten metal from the ladle 10.

Pouring tube 1 consists of an inner tubular portion 2 of a refractory heat insulating material and an outer layer of fibrous material 3.

The upper end of the tube is tapered internally at 5 to mate with an externally tapered outlet nozzle 4 which is fitted to the bottom of the slide gate 19.

The pouring tube 1 is held in place by a manipulator device and is located attached to a suitable fixed structure adjacent the location of the continuous casting mould and above the tundish. The manipulator device has a seating 20 in which sits a metal ring 6 which is attached to a metal collar affixed to the upper end of the pouring tube 1.

The pouring tube 1 may be replaced after each ladleful of molten metal has been discharged through it into the tundish 12, or, if undamaged, it may be retained. If desired, an inert atmosphere e.g. nitrogen or argon, may be injected into the pouring tube 1 to provide an inert atmosphere between the exterior of the stream of molten metal issuing from nozzle 4 and the interior walls of inner tubular section 2.

Figure 2:
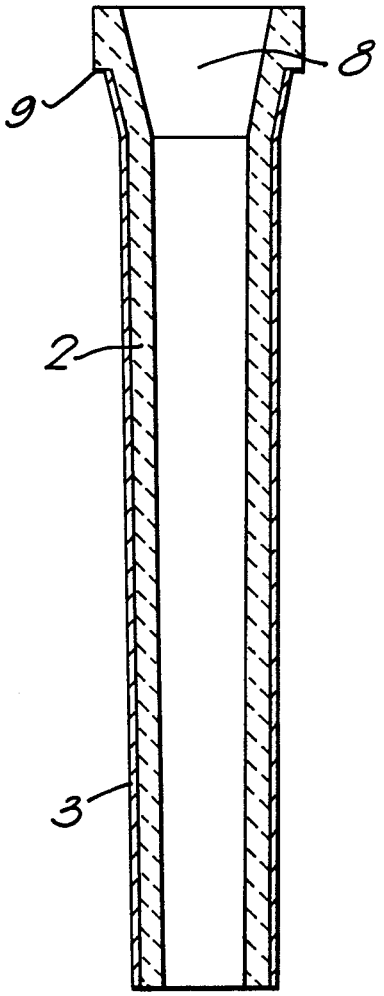
FIG. 2 shows an alternative form of pouring tube according to the invention.

FIG. 2 shows a pouring tube construction similar to that shown in FIG. 1 consisting of an inner tubular section 2 and an outer fibrous mat 3. The upper end of the tube is coned out at 8 internally to match the nozzle block 4 and externally at 9 to provide an engagement for a support ring or to provide that the tube may be directly supported on the pouring tube manipulator device.

Figure 3:
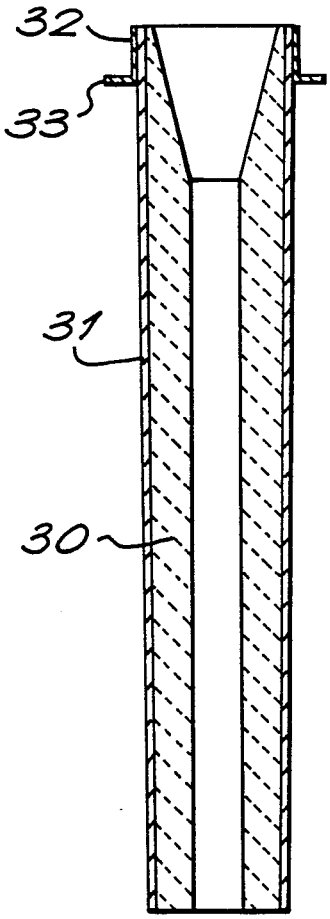
FIG. 3 shows a further alternative form of pouring tube according to the invention.

FIG. 3 shows a further pouring tube construction consisting of an inner refractory tubular section 30 having a spiral wound wrapping of glass fibre tape 31 impregnated with a bonded finely particulate silicon nitride suspension. Attached at the top end by refractory cement is a short cylinder 32 of perforated metal having welded to its lower periphery an annular support flange 33.

I claim:

1. A pouring tube for use in casting molten metal consisting of an inner tube of refractory heat insulating material, said inner tube having an exterior peripheral surface; and an outer layer of fibrous mat intimately laminated to said inner tube only over substantially all of said exterior peripheral surface thereof.

2. The pouring tube of claim 1 wherein the fibrous mat is a helically wound strip.

3. The pouring tube of claim 1 wherein the tube of refractory heat insulating material is formed of a composition comprising particulate refractory material, fibre and binder.

4. The pouring tube of claim 1 wherein the fibrous mat is formed of ceramic fibres.

5. The pouring tube of claim 1 wherein the fibrous mat is formed of refractory fibres.

6. The pouring tube of claim 1 wherein the fibrous mat is impregnated with particulate refractory material.

7. The pouring tube of claim 5 wherein the fibrous mat is further impregnated with a binding agent.

8. The pouring tube of claim 1 and including a metal support ring attached to one end thereof.

* * * * *